United States Patent [19]

Steinfield et al.

[11] Patent Number: 4,820,071

[45] Date of Patent: Apr. 11, 1989

[54] ACCESSORY HOLDER FOR RING BINDER

[75] Inventors: Robert J. Steinfield; Sterling Woodruff, both of Palo Alto, Calif.

[73] Assignee: Woodfield Products, Palo Alto, Calif.

[21] Appl. No.: 158,772

[22] Filed: Feb. 22, 1988

[51] Int. Cl.[4] ..... B42F 13/00; B42F 13/16; B42F 13/40

[52] U.S. Cl. ..... 402/4; 402/80 R; 281/30

[58] Field of Search ..... 402/4, 156, 80 R; 281/29, 30

[56] References Cited

U.S. PATENT DOCUMENTS

| | | | |
|---|---|---|---|
| 1,039,296 | 9/1912 | Krumming | 281/30 X |
| 1,308,437 | 7/1919 | Metcalfe | 281/30 |
| 1,904,572 | 4/1933 | Trussell | 281/30 X |
| 2,005,474 | 6/1935 | Schade | 402/4 X |
| 2,068,470 | 1/1937 | Rezner | 402/4 X |
| 2,097,626 | 11/1937 | Lesti | 402/4 |
| 2,200,146 | 5/1940 | Block | 281/30 |
| 2,397,685 | 4/1946 | Niemann | 402/4 |
| 2,647,517 | 8/1953 | Bilbrey | 402/4 |
| 2,821,197 | 1/1958 | Bilbrey | 402/4 |
| 2,954,034 | 9/1960 | Osteen | 402/4 |

*Primary Examiner*—Paul A. Bell

*Attorney, Agent, or Firm*—Fleit, Jacobson, Cohn & Price

[57] ABSTRACT

An elongated tubular body is provided for reception within the confines of closed rings of a "ring binder" and with the body spaced radially inwardly from the inner surfaces of the rings sufficient to enable sheets of paper slidingly engaged with the rings to slide thereabout without interference with the tubular body. The tubular body includes a first side opposing the base of the "ring binder" ring assembly from which the rings are mounted and the body first side is stationarily secured to the base. A second side of the body remote from the first side has a saddle-cut opening formed therein and a thin wall cover closely overlies the second s de closing the opening and is guidingly mounted from the body for shifting relative thereto between positions opening and closing the opening.

17 Claims, 2 Drawing Sheets

ACCESSORY HOLDER FOR RING BINDER

BACKGROUND OF THE INVENTION

1. Field of the Invention

The invention consists of a simple device designed to hold pens, pencils, rulers and other implements within the rings of a "ring binder" commonly used in schools, businesses and government.

Present methods of storing accessories of this type include the provision of pockets of various materials which have a flap in which holes are punched and which pockets are held in a binder in the same manner a piece of paper is retained therein, or such pockets have been made a part of the inside of the outer cover of the binder.

These previously used methods incorporate either separate attachments to or take up space in the binder itself, thereby reducing the volume of material the "ring binder" can hold.

The instant invention utilizes the space within the confines of the binder rings themselves. In this manner, the maximum possible volume of the binder is not reduced.

With the exception of small ring mechanisms, most ring binder mechanisms are equipped with levers at either end to assist in opening the rings. In addition to the pocket type of containers for containing accessories, some "ring binders" have been provided with accessory containers within the confines of the rings thereof. However, some of these containers must be removed from the associated binder to be opened.

2. Description of Related Art

Various different forms of "ring binder" accessory containing enclosures including some of the general structural and operational features of the instant invention heretofore have been provided such as those disclosed in U.S. Pat. Nos. 457,947; 1,467,534; 1,904,572; 2,035,571; 2,068,470; 2,160,392; 2,200,146; 2,490,141; 2,647,517; 2,821,197; 3,126,891; 3,283,421; and 4,361,947. However, these previously known forms of accessory containers do not include the overall structural and operational features of the instant invention.

SUMMARY OF THE INVENTION

The accessory holder of the instant invention comprises a tubular housing structure for permanent or removable attachment to the tubular metal base structure from which the openable rings of a "ring binder" are supported. The tubular housing structure is of a size and shape to be received within the rings of the "ring binder" when the rings are closed and includes outer surfaces spaced sufficiently from the inner surfaces of the rings to enable sheets of paper supported from the rings to move thereabout without interference with the tubular housing structure.

In addition, one side of the tubular housing structure includes an opening formed therein and a close fitting cover is supported from the tubular housing structure for movement between open and closed positions without interference with the levers of an associated "ring binder" provided to assist in opening the rings thereof. Also, the tubular housing structure includes a side remote from the open side thereof which opposes and is mounted from the tubular metal base structure for the rings of the associated "ring binder" and which may be contoured to conform to the cross sectional shape of the tubular metal base structure.

Various means may be provided for securing the tubular housing structure from the tubular metal base structure of the "ring binder", which means may include any suitable form of fasteners, double sided adhesive tape or a magnetic strip if the tubular housing structure and metal base structure of the "ring binder" are constructed of ferrous materials.

The main object of this invention is to provide a storage container for various accessories and with the storage container being readily openable and closable and supported within the confines of closed rings of a "ring binder" in spaced relation relative to the inner surfaces of the rings.

Another object of this invention is to provide an accessory holder in accordance with the preceding object and which may be readily incorporated into the manufacture of newly constructed "ring binders" and also readily added to existing "ring binders".

A further important object of this invention is to provide an accessory holder which may be readily constructed of different cross sectional shapes in order to conform to "ring binder" rings of different shapes.

Yet another object of this invention is to provide accessory holders for "ring binders" and wherein the holders include open sides thereof with which openable and closable covers are operatively associated and wherein the covers may be readily shifted between open and closed positions by even children and disabled persons.

A final object of this invention to be specifically enumerated herein is to provide an accessory holder for a "ring binder" and which will conform to conventional forms of manufacture, be a simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
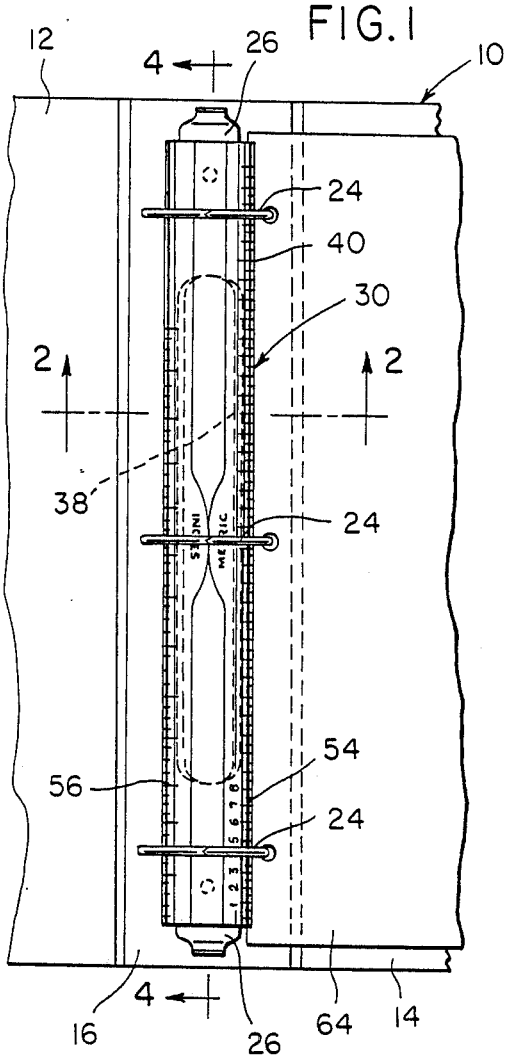
FIG. 1 is a fragmentary plan view of a conventional form of "ring binder" with which an accessory holder constructed in accordance with the present invention is operatively associated.

Referring now more specifically to FIGS. 1–4 of the drawings, the numeral 10 generally designates a conventional form "ring binder" including front and back panels 12 and 14 interconnected by a stiff binder back 16 along whose inner surface and openable and closable ring assembly referred to in general by the reference numeral 18 is secured. The ring assembly 18 includes a tubular base 20 secured to the binder back 16 through the utilization of rivets 22 and the tubular base 20 includes three sets of openable rings 24 supported therefrom for movement between the closed positions thereof illustrated in FIGS. 1 and 2 and the open positions thereof illustrated in FIG. 3. The ring assembly additionally includes opposite end levers 26 which may be used to assist in opening the rings 24.

The foregoing comprises a description of a conventional form of ring assembly.

The accessory holder of the instant invention is referred to in general by the reference numeral 30 and includes a substantially cylindrical plastic body 32 having opposite end walls 34. The upper portion of the longitudinal mid-portion of the body 32 is saddle cut as at 36 to define an upwardly opening 38 for receiving articles to be stored within the body 32 and a partial cylindrical plastic cover 40 is provided and includes partial opposite end walls 42.

The opposite end walls 34 include center deep detent recesses 44 formed in the outer surface thereof as well as upper considerably shallower recesses 46. The end walls 42 include lower portions on whose inner surfaces projections 48 are formed receivable in the recesses 44 as well as smaller projections 50 receivable in the recesses 46. When the projections 48 and 50 are disposed in the corresponding recesses 44 and 46, the cover 40 closely overlies and closes the opening 38. However, the cover 40 may be manually swung, in either direction, from the closed position thereof illustrated in FIGS. 1 and 2 in order to expose the opening 38. When the cover 40 is swung relative to the body 32, the cover 40 pivots about an axis extending between the projections 48. The smaller projections and recesses 50 and 46 yieldingly secure the cover 40 in the closed position.

Figure 2:
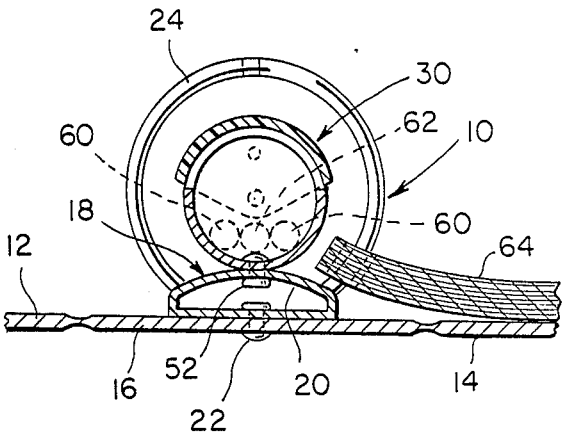
FIG. 2 is an enlarged fragmentary vertical sectional view taken substantially upon the plane indicated by the section line 2—2 of FIG. 1.
Figure 3:
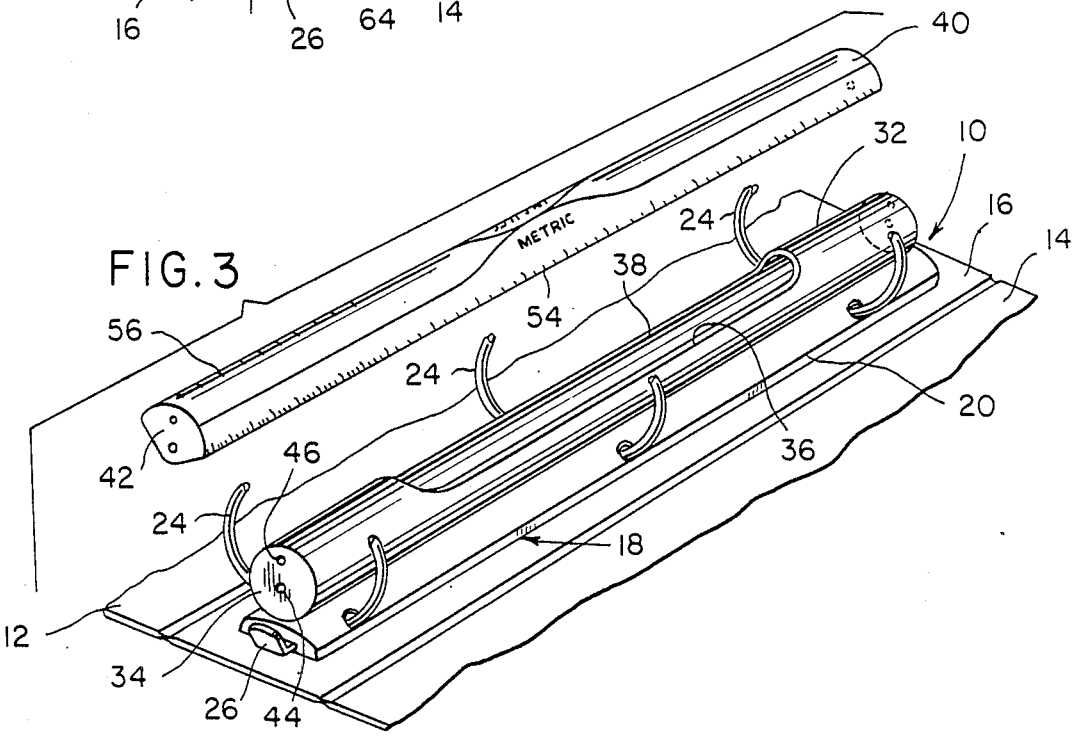
FIG. 3 is a perspective view of the structure illustrated in FIG. 1 with the rings of the "ring binder" in open positions and the pivoting cover for the accessory holder in an exploded position.
Figure 4:
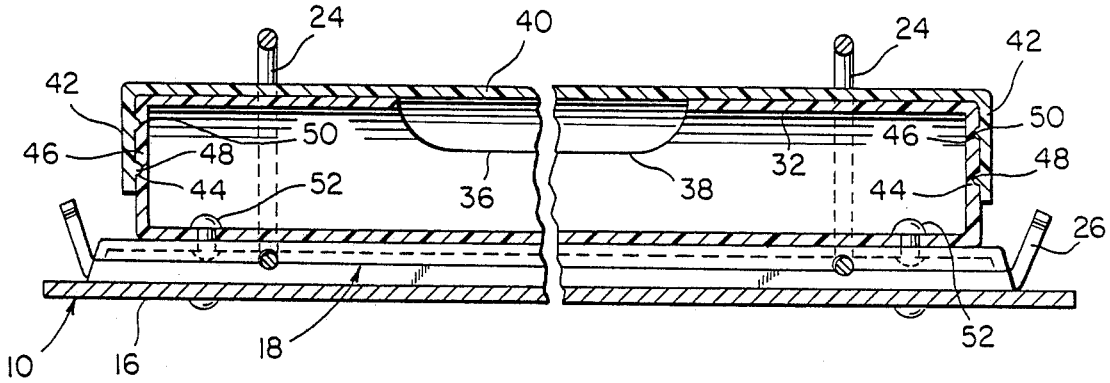
FIG. 4 is a fragmentary enlarged longitudinal vertical sectional view taken substantially upon the plane indicated by the section line 4—4 of FIG. 1.

As may be seen from FIG. 2 of the drawings, the lower peripheral portion of the body 32 is secured to the upper wall portion of the tubular body 20 through the utilization of rivets 52, although other suitable forms of shank type fasteners may be used.

The opposite side marginal portions of the cover 40 are provided with different measurement scale indicia 54 and 56 and may be used whenever necessary.

As may be seen from FIG. 2, a plurality of pencils 60 as well as a pen 62 may be contained within the body 32. In addition, other accessories may be stored within the body 32.

It will be noted that the mounting of the cover 40 and the movement thereof between the open and the closed positions does not interfere with the levers 26. Further, the mounting of the body 32 is such that it is centrally disposed relative to the rings 24 and there is sufficient radial spacing between the inner surfaces of the rings 24 and the body 32 and the cover 40 to enable free movement of paper sheets 64 supported from the rings about the latter without interference with the body 32 or cover 40.

Figure 5:
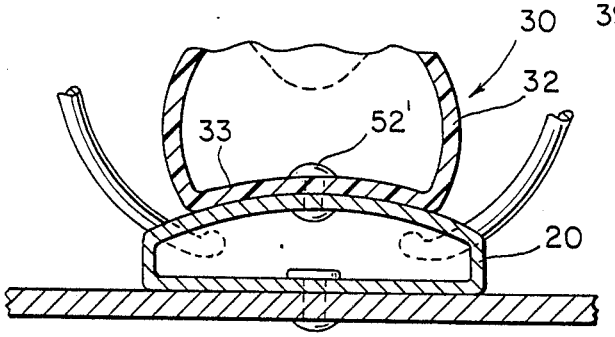
FIG. 5 is an enlarged fragmentary vertical sectional view similar to FIG. 2 but illustrating a modified form of holder incorporating a contoured undersurface.

With attention now invited more specifically to FIG. 5 of the drawings, there may be seen a first modified form of accessory cover referred to in general by the reference numeral 30'. The holder 30' is substantially identical in construction and operation to the holder 30, except that the lower bottom wall 33 of the body 32' thereof is transversely arcuate to conform to the opposing surface of the tubular body 20. In this manner, the rivets 52' corresponding to the rivets 52 may more securely fasten the body 30' to the tubular body 20.

Figure 6:
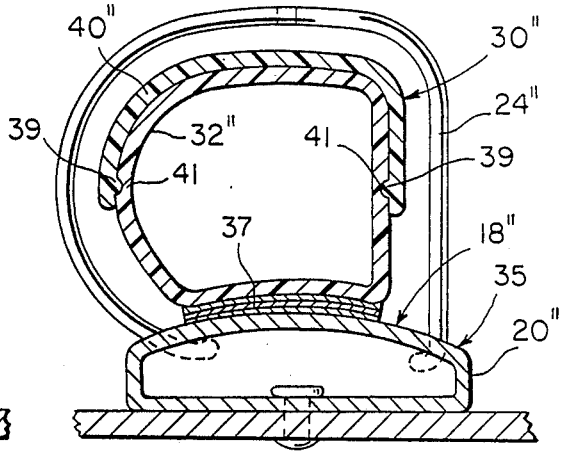
FIG. 6 is a fragmentary vertical sectional view similar to FIG. 5 but illustrating a second modified form of holder constructed to conform to D-shaped rings of a "ring binder"

With attention now invited more specifically to FIG. 6 of the drawings, a second modified form of accessory holder is referred to in general by the reference numeral 30''. The accessory holder 30'' is illustrated in conjunction with a "ring binder" 35 corresponding to the "ring binder" 10, but which includes a ring assembly referred to in general by the reference numeral 18'' incorporating D-shaped rings 24'' instead of circular rings. In addition, he accessory holder 30'' is secured to the tubular base 20'' of the ring assembly 18'' through the utilization of double sided adhesive tape 37 and the plastic body 32'' of the holder 30'' includes a sliding plastic cover 40'' including longitudinal ribs 39 slidingly received in longitudinal grooves 41 formed in the body 32''. It will be noted that the entire lower portion of the cover 40'' is open and thus the levers of the ring assembly 18'' corresponding to the levers 26 will not interfere with sliding movement of the cover 40'' between open and closed positions.

Figure 7:
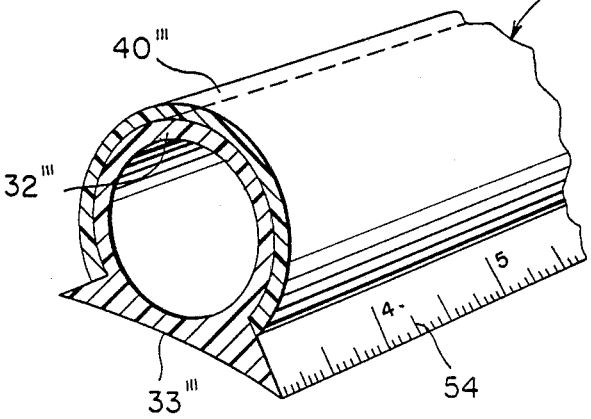
FIG. 7 is a fragmentary perspective view of a third modified form of holder utilizing a slidable cover and equipped with opposite side scales.

With attention now invited more specifically to FIG. 7, a third modified form of accessory holder 30''' is illustrated. The accessory holder 30''' includes an arcuate bottom wall 33''' corresponding to the arcuate bottom wall 33 and which may be secured to a corresponding "ring binder" back (not shown) through the utilization of rivets or double sided tape. Opposite side portions of the body 32''' of the holder 30''' include scales 54''' and a partial cylindrical cover 40''' is provided and slidingly engaged with the body 32'''. In addition, if the cover 40''' is constructed of resilient plastic, it may be snap disengaged from the body 32''' as well as shifted longitudinally relative to the body 32''' in order to open the body.

Figure 8:
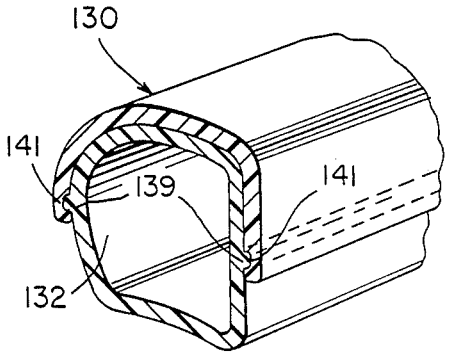
FIG. 8 is a fragmentary perspective view of a fourth modified form of holder to be used in conjunction with a "ring binder" equipped with D-shaped rings and with the holder equipped with a slidable and snap-fit engageable cover.

Finally, with attention now invited more specifically to FIG. 8 of the drawings, a fourth form of holder 130 is illustrated and comprises a substantial duplicate of the holder 30''' except that the plastic body 132 of the holder 130 is equipped with ribs 139 and the plastic cover 140 corresponding to the cover 40'' is equipped with longitudinal grooves 141 in which the ribs 139 are slidingly received.

Each of the plastic covers 40, 40'', 40''' and 140 may be snap engaged with the corresponding plastic body. The cover 40 as well as a corresponding cover for the body 30' are pivoted between open and closed positions and the covers 40'', 40''' and 140 are slidingly shifted between open and closed positions although these covers as well as the cover 40 may be snap disengaged from the corresponding body.

The foregoing is considered as illustrative only of the principles of the invention. Further, since numerous modifications and changes will readily occur to those skilled in the art, it is not desired to limit the invention to the exact construction and operation as shown and described, and accordingly, all suitable modifications and equivalents may be resorted to, falling within the scope of the invention.

What is claimed as new is as follows:

1. In combination with a ring binder of the type including an elongated ring assembly base extending along and secured to the inner surface of a binder back relative to opposite longitudinal side marginal portions of which front and rear panels of the binder are pivotly attached and wherein the ring assembly base includes aligned, openable and closable rings spaced along said base and disposed in planes generally normal to the longitudinal extent of said base, an accessory holder including an elongated tubular body closed at its opposite ends by transverse end walls and having a first longitudinal side overlying and secured to said base within the confines of said rings, a second longitudinal side of said body remote from said first side having an access opening therein through which articles may be inserted into and removed from the interior of said body, a thin wall cover closely overlying and conforming to the shape of said second side and closing said opening, said cover being guidingly mounted from said body for shifting relative thereto between positions opening and closing said opening, said body and cover being spaced from the inner surfaces of said rings, when the latter are closed, sufficient to enable sheets of paper slidingly mounted on said rings to slide thereabout without interference with said body or cover.

2. The ring binder and holder of claim 1 wherein said cover includes opposite end partial end walls overlying the exterior surfaces of said body end walls, said cover and body end walls including coacting detent and projection means disposed generally upon a center axis extending through said rings and mounting said cover from said body for oscillation relative thereto about said axis between said positions opening and closing said opening.

3. The ring binder and holder of claim 2 wherein said detent projection and recess means include detent recesses formed in the outer surfaces of said body end walls and detent projections formed on the inner surfaces of said cover partial end walls.

4. The ring binder and holder of claim 2 wherein corresponding portions of said body and cover end walls include second coacting detent and projection means spaced radially of said axis from the first mentioned coacting detent and projection means for releasably retaining said cover in a position closing said opening.

5. The ring binder and holder of claim 1 wherein said body and cover include coacting means mounting said cover from said body for shifting longitudinally of said body between said positions opening and closing said opening.

6. The ring binder and holder of claim 5 wherein said body is generally D-shaped in transverse cross section.

7. The ring binder and holder of claim 5 wherein at least the upper portion of said body is partially cylindrical in shape.

8. The ring binder and holder of claim 5 wherein said body is generally D-shaped in transverse cross section, opposite sides of said body including longitudinally extending and outwardly projecting ribs thereon, said cover including opposite side inwardly opening grooves formed therein in which said ribs are slidingly received.

9. The ring binder and holder of claim 8 wherein said cover is removably snap engaged with said body.

10. The ring binder and holder of claim 5 wherein said body is generally D-shaped in transverse cross section, opposite side longitudinal portions of said cover including inwardly projecting longitudinally extending ribs, opposite side longitudinal marginal portions of said body including outwardly opening longitudinal grooves formed therein in which said ribs are slidingly disposed.

11. The ring binder and holder of claim 10, wherein said cover is constructed of resilient material and removably snap engaged with said body.

12. The ring binder and holder of claim 1 wherein said first longitudinal side of said body is secured to said base through the utilization of shank type fasteners.

13. The ring binder and holder of claim 1 wherein said base and first side of said body are arcuate in transverse shape and conform to each other.

14. The ring binder and holder of claim 13 wherein said first side of said body is secured to said base through the utilization of shank type fasteners.

15. The ring binder and holder of claim 13 wherein said first side of said holder is secured to said base through the utilization of double sided tape.

16. The ring binder and holder of claim 1 wherein said cover includes opposite end partial end walls overlying the exterior surfaces of said body end walls, said cover and body end walls including coacting detent and projection means disposed generally upon a center axis extending through said rings and mounting said cover from said body for oscillation relative thereto about said axis between said positions opening and closing said opening, said cover including opposite longitudinal marginal portions along which measuring scale indicia are disposed.

17. The ring binder and holder of claim 1 wherein opposite side marginal portions of said body include scale indicia spaced therealong.

* * * * *